US008845015B2

(12) United States Patent
Anderson

(10) Patent No.: US 8,845,015 B2
(45) Date of Patent: Sep. 30, 2014

(54) PACKAGED QUICK ASSEMBLY PICNIC TABLE

(75) Inventor: Mark A. Anderson, Canton, OH (US)

(73) Assignee: Stark Truss Company, Inc., Canton, OH (US)

( * ) Notice: Subject to any disclaimer, the term of this patent is extended or adjusted under 35 U.S.C. 154(b) by 195 days.

(21) Appl. No.: 13/540,922

(22) Filed: Jul. 3, 2012

(65) Prior Publication Data

US 2014/0008944 A1 Jan. 9, 2014

(51) Int. Cl.
*A47B 83/02* (2006.01)

(52) U.S. Cl.
CPC ..... *A47B 83/02* (2013.01)
USPC ..... 297/158.4; 297/158.5

(58) Field of Classification Search
CPC ..... A47B 3/14; A47B 3/0912; A47B 83/02
USPC ..... 297/157.1, 158.5, 158.4, 159.1, 158.3; 108/162, 174
See application file for complete search history.

(56) References Cited

U.S. PATENT DOCUMENTS

| | | | | | |
|---|---|---|---|---|---|
| 1,956,483 | A | * | 4/1934 | Alpers | 297/141 |
| 2,512,473 | A | * | 6/1950 | Alch | 297/158.4 |
| 2,579,934 | A | * | 12/1951 | Krasney | 108/131 |
| 2,766,812 | A | * | 10/1956 | Schrader | 297/141 |
| 4,060,275 | A | * | 11/1977 | Hansen | 297/158.4 |
| 4,537,443 | A | * | 8/1985 | Bray | 297/158.5 |
| 5,018,785 | A | * | 5/1991 | Monson et al. | 297/158.4 |

FOREIGN PATENT DOCUMENTS

FR 2621895 A * 4/1989

* cited by examiner

*Primary Examiner* — Milton Nelson, Jr.
(74) *Attorney, Agent, or Firm* — Renner, Kenner, Greive, Bobak, Taylor & Weber Co, LPA

(57) ABSTRACT

A packaged quick assembly picnic table has a tabletop with a pair of leg subassemblies hingedly connected to a bottom side of the table. A pair of side beams is received upon the pair of leg subassemblies, with a pair of bench seats sandwiching the pair of side beams. A binder, such as straps, shrink wrap or the like, secures the tabletop, pair of leg assemblies, pair of side beams and pair of seats together, all being secured within a perimeter defined by the tabletop. There is thus presented a packaged quick assembly picnic table that is secure, stable for stacking, easy to move and maneuver, and capable of quick assembly when delivered to a final location.

8 Claims, 3 Drawing Sheets

PACKAGED QUICK ASSEMBLY PICNIC TABLE

TECHNICAL FIELD

The invention herein resides in the art of packaging technology and, more particularly, to the packaging of disassembled structures broken down in such a manner as to accommodate ease of assembly upon reaching a final destination. More particularly, the invention relates to a packaged quick assembly picnic table maintained in a stable structure of uniform dimensions and weight distribution.

BACKGROUND OF THE INVENTION

Presently, it has become somewhat commonplace for structural items to be packaged and shipped in a disassembled condition, ready for assembly by the consumer upon reaching a final destination. Bulky items, such as furniture and the like are often packaged and shipped in such a manner to minimize shipping costs by reducing the volume of the package. A tradeoff often exists between the size of the package and the ultimate ease of assembly. Accordingly, the structure of the product must be given to both ease of assembly and cost effectiveness of the packaging, without sacrificing either.

Great concern must also be given to the stability of the package. In many "big box" stores, packages or boxes are stacked atop each other for ready access by consumers. For primary reasons of safety, and also for reasons of precluding damage to packaging and product, it is most desirable that the packages stack evenly and uniformly, with even weight distribution, and with standard geometric configurations given to stackability, and further without any extensions or protrusions from the packaging that might be given to inadvertent contact by shoppers or passersby.

It is most desirable that packaged products be presented in such a fashion that the assembly effort is minimized. Such is conducive to customer satisfaction. It is similarly desired that the packaging itself be as small, compact, stable, and easy to handle as possible.

Picnic tables are among the types of products that can be sold in a disassembled fashion, but heretofore their packaging has been less than desirable. Known prior packaging techniques have often resulted in a package having portions extending well beyond the necessary confines dictated by the size of the table top, and such packaging has led to instability in stacking, difficulty in handling, and generally unsightly appearance. The invention herein is directed to the packaging of a disassembled, ready-to-assemble, picnic table of the standard type such as that identified by the numeral 10 in FIG. 1. As shown therein, the picnic table 10 includes a tabletop 12 made of a plurality of planks or boards 14 held together as by a stringer or the like. Connected to and extending downwardly from the tabletop 12 are pairs of legs 16 at each end thereof, the legs typically being angled outwardly for purposes of support and stability. In somewhat standard fashion, the legs extend outwardly at an angle of 30°-45° from the tabletop. Each pair of legs 16 is interconnected by an appropriate beam 18 as by bolts 20. A pair of bench seats 22, formed by planks or boards 24, extend parallel to the tabletop 12 and are supported at opposite ends thereof by associated cantilevered ends of the beams 18, as shown. A brace 26 extends from and interconnects a bottom surface of tabletop 12 to a center of the beam 18 at each end of the table 10.

While the picnic table 10 is sturdy and useful, it is bulky and not given to ease of shipping, display or the like. Previous attempts at packaging a disassembled picnic table have generally not been successful in that they have not been sufficiently compact, nor configured to be stable in stacking. They have typically not been of uniform compactness, even weight distribution, or given to the confines of a rectangular package.

There is a need in the art for a compact, stable, uniform, packaged picnic table that is easily and readily assembled upon reaching its final destination.

DISCLOSURE OF INVENTION

In light of the foregoing, it is a first aspect of the invention to provide a packaged quick assembly picnic table that is given to packaging within the confines of the perimeter of the tabletop.

It is another aspect of the invention to provide a packaged quick assembly picnic table that is compact and of substantially even weight distribution.

Yet a further aspect of the invention is the provision of a packaged quick assembly picnic table that is given to ease of stacking in a safe and secure manner.

Still a further aspect of the invention is the provision of a packaged quick assembly picnic table which is adapted for packaging in a small footprint, while being given to ease of assembly of a stable and secure product.

The foregoing and other aspect of the invention that are attained by the invention presented and described herein are achieved by a packaged quick assembly picnic table, comprising: a tabletop; a pair of leg subassemblies connected to a bottom side of said tabletop; a pair of side beams received upon said pair of leg subassemblies; a pair of seats sandwiching said pair of side beams; and a binder securing said tabletop, pair of leg subassemblies, pair of side beams and pair of seats together, all within a perimeter defined by said tabletop.

DESCRIPTION OF DRAWINGS

For a complete understanding of the various aspects, structures and techniques of the invention reference should be made to the following detailed description and accompanying drawings wherein.

BEST MODE AND PREFERRED EMBODIMENT OF THE INVENTION

Figure 1:
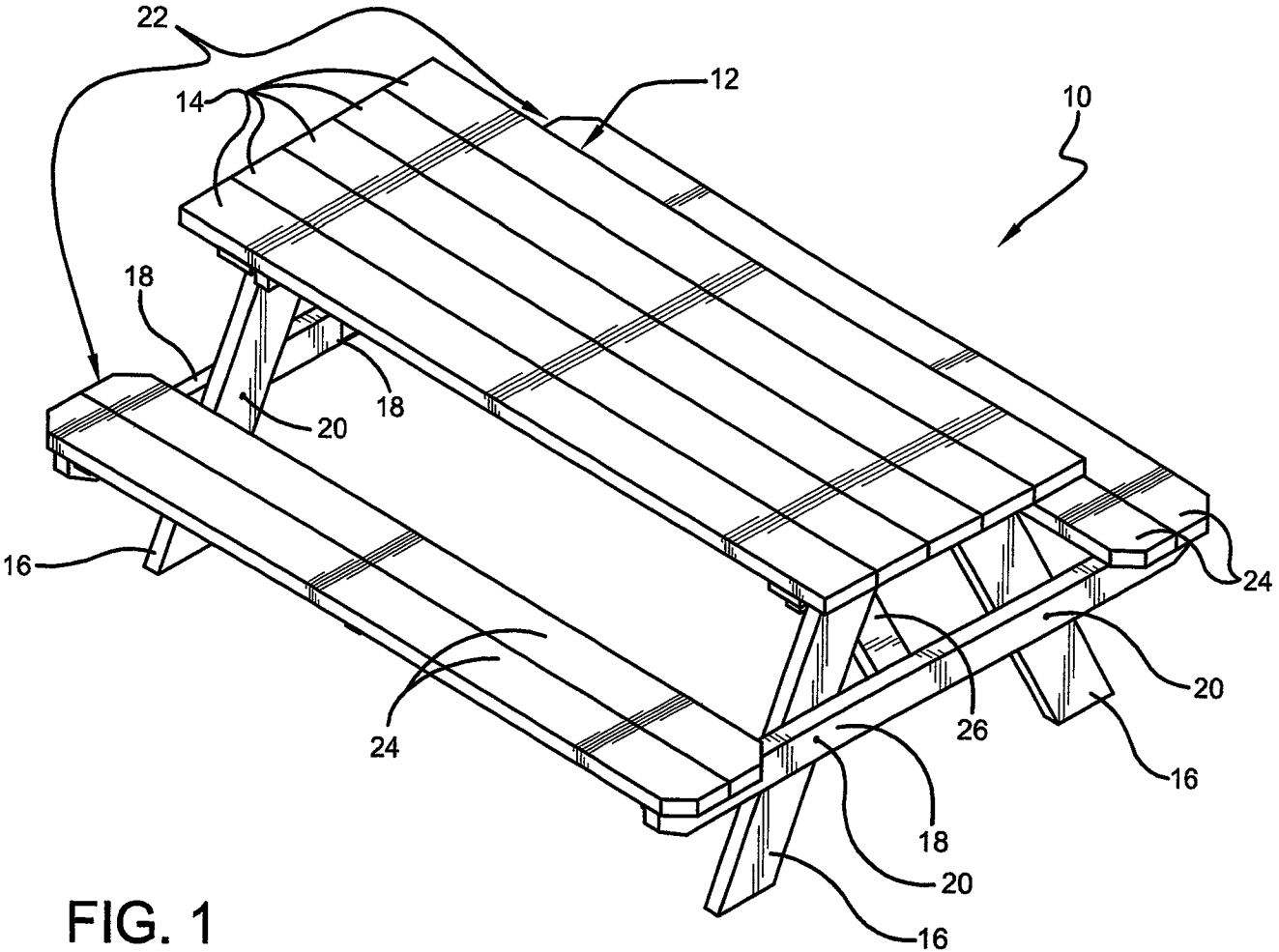
FIG. 1 is a perspective view of a picnic table made in accordance with the invention.
Figure 2:
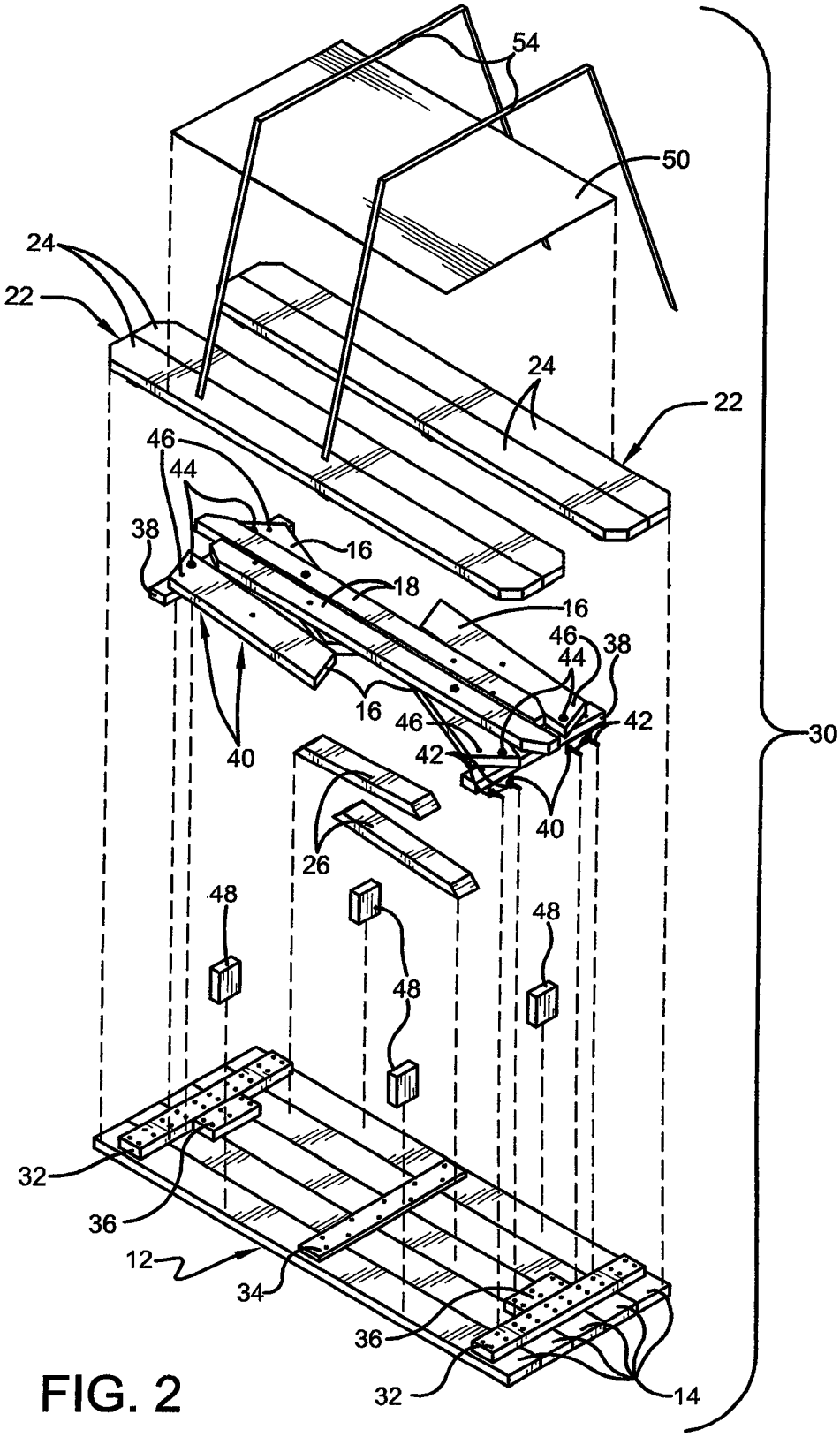
FIG. 2 is an assembly diagram of the packaging of the picnic table of FIG. 1 in a disassembled state, ready for assembly upon reaching a final destination.
Figure 3:
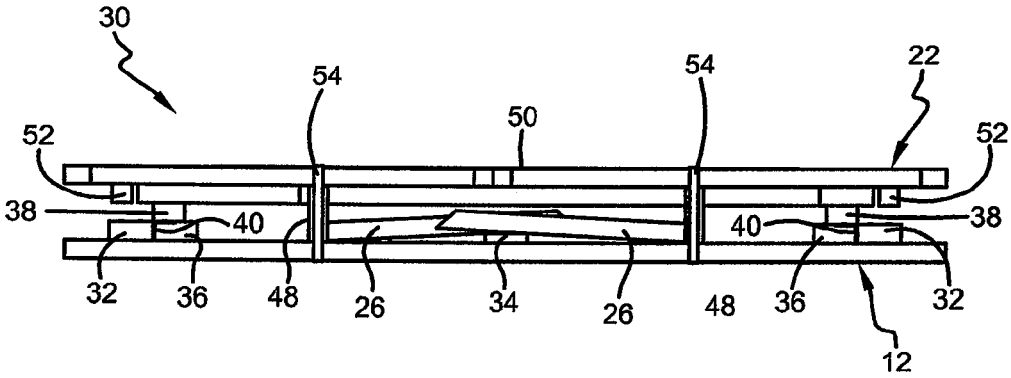
FIG. 3 is a side elevational view of the packaging of FIG. 2.
Figure 4:
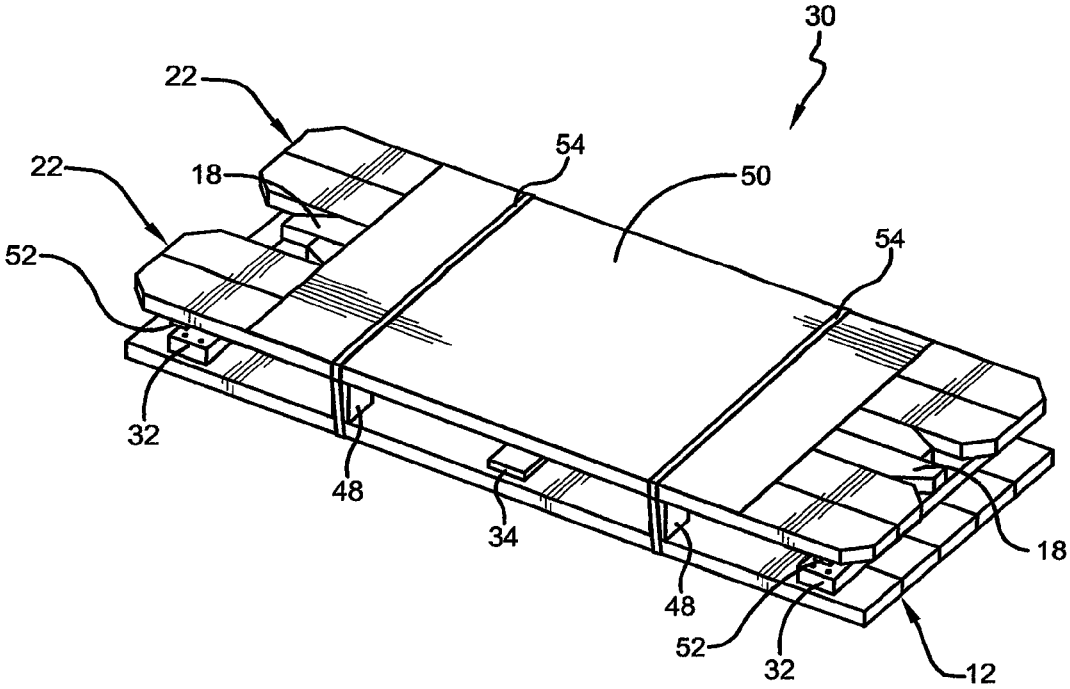
FIG. 4 is a perspective view of the packaging of FIG. 2 fully bound and ready for shipment.

As described above with regard to FIG. 1, the picnic table 10 of the invention is of a somewhat standard nature, but is given to ease of packaging, shipping and assembly in a nature to be described herein with regard to FIGS. 2-4. With particular reference to FIG. 2, it can be seen that a packaging arrangement for a quick assembly picnic table is designated generally by the numeral 30. A base of the package consists of the tabletop 12 formed from a parallel interconnected arrangement of planks or boards 14 and held together by end stringer boards 32 at opposite ends of the top 12. A center stringer board 34 may also be employed for purposes of structural integrity. The stringer boards 32, 34 are nailed, screwed, or otherwise appropriately attached to each of the planks or boards 14, as shown. Reinforcing plates or spacer boards 36 are affixed to the bottom side of the tabletop 12 and centrally positioned between the stringer boards 32, as shown. While any suitable material might be employed, it will be appreciated that the stringer boards 32 and reinforcing plates or spacer boards 36 are of the same material of construction, typically of 2"×4" material. The center stringer board 34 is typically of 1"×4" material.

A pair of leg plates 38 are received by and rest upon an associated reinforcing plate or spacer board 36. Each leg plate 38 has connected thereto a pair of hinges 40, one leaf of each of the hinges 40 being connected to the associated leg plate 38, and the other being connected to an associated end stringer board 32, by means of bolts 42, as shown.

Each leg plate 38 has a bolt 44 passing there through and pivotally securing an associated leg 16, as shown. The nut (not shown) associated with each bolt 44 is tightened sufficiently to secure the leg 16 to the leg plate 38, while still accommodating a forceful pivotal movement of the leg 16 about the bolt 44 as a pivot point. As shown, holes 46 also pass through each of the legs 16 and leg plates 38, which may be brought into alignment when the leg 16 is rotated about the pivot point 44 and may subsequently be locked in position by an appropriate nut and bolt engagement such that the legs are spread as shown in FIG. 1. In other words, the holes 46 are equidistant from the associated pivot point 44 so that they can be brought into alignment to receive a securing bolt It will be appreciated that a pair of legs 16 pivotally connected as at 44 to an associated leg plate 38 and having a pair of hinges 40 attached thereto, defines a leg subassembly connected to the bottom of the tabletop 14 as by bolting to the respective end stringer boards 32. Each of the leg subassemblies has one of the legs 16 extending substantially laterally with regard to the tabletop 12 and the other angled inwardly toward that lateral leg; to provide a space for receiving the pair of braces 26, as shown in FIG. 2. Next, the pair of beams 18 may be placed upon the leg subassemblies and may then be sandwiched between the pair of bench seats 22, which are then covered, to some extent, by an appropriate wrapper 50 having sales indicia, instructions, or the like and printed thereon. Prior to placement of the pair of bench seats 22, it may be desired to interpose stabilizer blocks 48, again preferably of 2"×4" construction, along opposite sides of the underside of the tabletop 12. The stabilizer blocks 48 are of such height as to receive the underside of the bench seats 22, 24, as best shown in FIG. 3.

With continued reference to FIG. 3, it can be appreciated that the resultant package is defined by a compact and uniformly distributed assembly, with the tabletop 12 establishing the bottom of the package and the bench seats 22, sandwiching the beams 18, establishing the top of the package. The total package is contained within the confines of the perimeter of the tabletop 12, being preferably on the order of approximately 6' in length and 2.5' in width. The height of the package is on the order of 7.5".

As shown in FIGS. 3 and 4, the resulting package 30 has sufficient integrity and stability to be stacked for display purposes and to be easily handled and maneuvered for placement in the bed of a standard pickup truck or even the trunk of a standard sized car. The package may be further bound by appropriate plastic straps 54, and may further be secured by means of a shrink wrap or other plastic wrapping.

When the packaged assembly 30 reaches its final destination, the straps 54 may be broken and any wrapping removed for easy access to all of the constituent parts of the picnic table. The packaged table can be easily be assembled by removing the bench seats 22, beams 18, stabilizer blocks 48 and braces 26. The legs 16 of each of the leg subassembles may then be pivoted outwardly such that the holes 46 of the legs 16 and leg plates 38 align. At this time, the legs 16 may be secured in locked position by means of nut and bolt engagement through the holes 46. The nut and bolt engagement provided by the pivot point 44 may also be further tightened to lock the legs in place. At this time, the bias cut of the legs 16 is in alignment with the leg plate 38 such that the leg subassembly may be pivoted by means of the hinges 40 to bring the edge of the leg plate 38 into engagement with the end stringer board 32. The beams 18 are pre-drilled, as are the legs 16 to have holes that align with each other for receipt of securing nut and bolt engagement. At this time, such engagement may be performed. Finally, with the table still lying on its face, braces 26 may be screwed to a center point on an associated beam 18 and center plank of the tabletop 12 to secure the leg subassemblies in their operative position. The beams and center plank may have pilot holes therein to receive screws for this purpose. At this time, the table may be turned over, resting on the biased cut feet of the legs 16, and with the beams 18 extending in cantilevered fashion beyond the perimeter of the tabletop 12. At this time, stringers 52 on the bottom and near each end of the bench seats 22, and having pre-drilled holes therethrough, may be secured to the cantilevered ends of the beams 18 by nut and bolt engagement through mating holes pre-drilled in the beam. With each seat 22 so affixed, the picnic table 10 is complete.

Thus it can be seen that the various aspects of the invention have been attained by the structure presented herein above. Various combinations of the features just described may constitute separate inventions in and of themselves and, accordingly, the invention is not limited to a particular total embodiment of features, but is more fully described in and limited to the following claims.

What is claimed is:

1. A packaged quick assembly picnic table, comprising:

a tabletop;

a pair of leg subassemblies connected to a bottom side of said tabletop;

a pair of side beams received upon said pair of leg subassemblies;

a pair of seats sandwiching said pair of side beams;

a binder securing said tabletop, pair of leg subassemblies, pair of side beams and pair of seats together, all within a perimeter defined by said tabletop; and wherein each said pair of leg subassemblies is hingedly attached to an associated end stringer board, a pair of braces is received upon said table beneath said pair of side beams, and stabilizer blocks are interposed between and engage each of said tabletop and one of said pair of seats.

2. The packaged quick assembly picnic table according to claim 1, wherein said binder comprises a pair of straps.

3. The packaged quick assembly picnic table according to claim 1, wherein said binder comprises a shrink wrap film.

4. The packaged quick assembly picnic table according to claim 1, wherein each of said leg subassemblies comprises a pair of legs, each pivotally connected to a leg plate by a bolt.

5. The packaged quick assembly picnic table according to claim 4, further comprising a reinforcing plate received by a bottom surface of said tabletop, and receiving and supporting an associated one of said leg plates.

6. The packaged quick assembly picnic table according to claim 4, wherein each said leg has a hole passing therethrough at a same distance from said bolt as a hole passing through said leg plate.

7. The packaged quick assembly picnic table according to claim 6, wherein each said side beam comprises an elongated member having holes therein positioned to align with holes in each of said pair of legs of an associated one of said leg subassemblies and each of said pair of seats.

8. A packaged quick assembly picnic table, comprising:

a tabletop;

a pair of leg subassemblies connected to a bottom side of said tabletop;

a pair of side beams received upon said pair of leg subassemblies;

a pair of seats sandwiching said pair of side beams;

a binder securing said tabletop, pair of leg subassemblies, pair of side beams and pair of seats together, all within a perimeter defined by said tabletop; and wherein each said pair of leg subassemblies is hingedly attached to an associated end stringer board and compromising a pair of legs, each pivotally connected to a leg plate by a bolt, each said leg having a hole passing therethrough at a same distance from said bolt as a hole passing through said leg plate, and wherein each said side beam comprises an elongated member having holes therein positioned to align with holes in each of said pair of legs of an associated one of said leg subassemblies and each of said pair of seats.

* * * * *